United States Patent [19]

Sluys

[11] 4,311,413

[45] Jan. 19, 1982

[54] CANTILEVERED FINGER PIERS FOR MARINE FLOATS

[75] Inventor: Wesley W. Sluys, Bellingham, Wash.

[73] Assignee: Builders Concrete, Inc., Bellingham, Wash.

[21] Appl. No.: 89,985

[22] Filed: Oct. 31, 1979

[51] Int. Cl.[3] ..... E02B 3/20

[52] U.S. Cl. ..... 405/219; 114/267; 405/221

[58] Field of Search ..... 405/218–221; 14/7, 36; 114/267

[56] References Cited

U.S. PATENT DOCUMENTS

| | | | |
|---|---|---|---|
| 2,109,797 | 3/1938 | Lubin | 14/36 |
| 2,964,767 | 12/1960 | Egbert | 405/218 X |
| 3,091,203 | 5/1963 | Usab | 405/219 X |
| 3,308,496 | 3/1967 | Mooney et al. | 14/36 |
| 3,686,876 | 8/1972 | Muschell | 405/220 |
| 3,952,528 | 4/1976 | Donkersloot | 405/221 |
| 4,197,034 | 4/1980 | Ødegaard | 405/218 X |

*Primary Examiner*—Dennis L. Taylor

*Attorney, Agent, or Firm*—Seed, Berry, Vernon & Baynham

[57] ABSTRACT

A plurality of relatively narrow finger piers project perpendicularly from mainwalk floats at spaced-apart locations. The finger piers are secured to the floats in cantilever fashion using a variety of fastening structures. Since loads carried by the finger pier are not supported by the buoyancy of the pier, the width and thickness of the pier can be substantially less than comparable floating finger piers. In one embodiment the pier is principally formed by a triangular frame which is secured to the mainwalk floats by either a mounting bracket or rods extending transversely through the mainwalk floats and longitudinally through upper corner pipes of the triangular frame. A deck is then fastened across the upper pipes. The vertical angle of each pier may be adjusted by rotating an adjusting nut which abuts the lower pipe of the triangular frame. In a second embodiment pairs of parallel beams are secured to the mainwalk floats by a bracket, and a deck is mounted on the upper surface of the beams. Spreader timbers or a buoyant foam may be mounted between the beams beneath the deck.

9 Claims, 8 Drawing Figures

FIG. 2
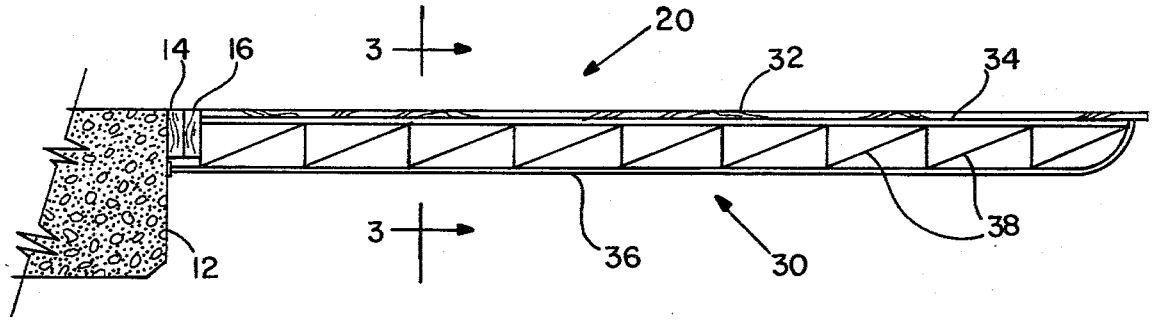
FIG. 3
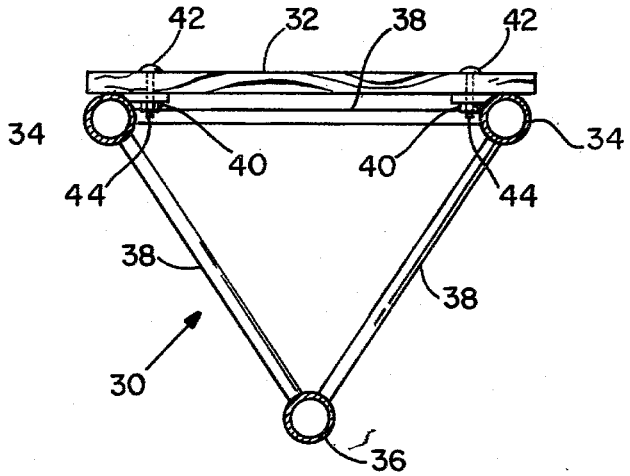
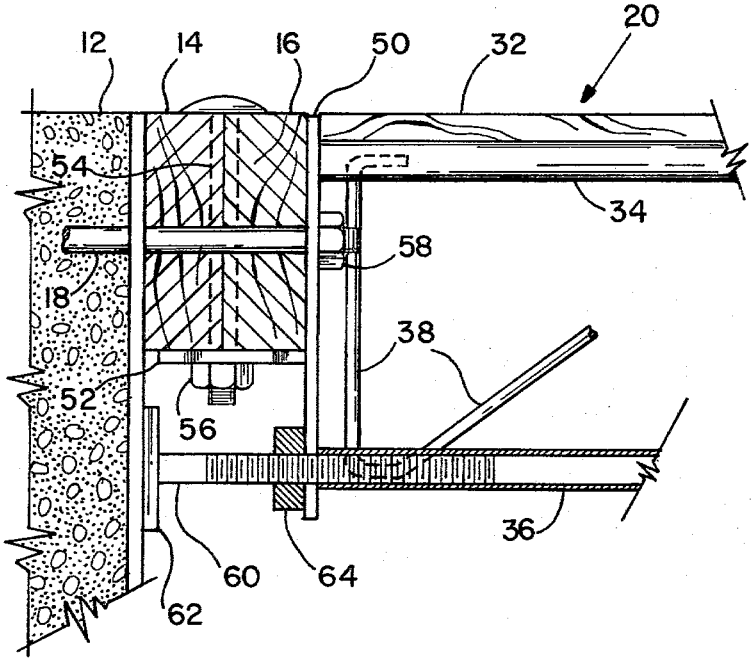
FIG. 4

CANTILEVERED FINGER PIERS FOR MARINE FLOATS

BACKGROUND OF THE INVENTION

1. Field of the Invention

This invention relates to marine piers, and more particularly to a relatively narrow finger pier which is secured to mainwalk floats in cantilever fashion.

2. Description of the Prior Art

Floating marine piers are commonly constructed with a number of relatively wide mainwalk piers which project from either the land or another pier, and a plurality of spaced-apart finger floats projecting perpendicularly from the mainwalk floats. Individual boats are then moored between the finger floats. Floating marine piers of this design have generally adequately served the needs of most marinas in which they are employed.

Recently the moorage requirements of many marinas have shifted from larger boats to smaller boats and to the compacting of existing facilities. Although large boats are still moored at marinas, an increasing number of small boat owners have elected to moor their boats instead of trailering them to and from a launching point. This trend is undoubtedly due to some extent to the use of smaller cars which are less able to pull even fairly small boats and to the increasing cost of energy consumed in boat trailering.

The increasing need for small boat moorage has resulted in a need for finger floats which are somewhat narrower than those conventionally used in moorages for larger boats. Unfortunately, narrow finger floats often are not able to support the weight of individuals walking along the floats. In order for a float to support a given load, the float must displace a volume of water having a weight equal to the weight of the load. Consequently, the finger float must either be relatively wide or relatively deep to provide the volume necessary to displace a sufficient volume of water to support commonly received loads such as individual and loads they can carry. Relatively wide finger floats are undesirable, as pointed out above, since wide finger floats preclude compact moorage. While relatively thick finger floats do allow compact moorage, they are undesirable because while floating unattached to the mainwalk the float would be thicker than it would be in width; and consequently, natural forces, caused by the center of buoyancy being at a critical point above the water line, force the float to lie on its side. In addition, these floating torsional forces on the finger float require larger and stronger holding devices where attachment is made to the mainwalk. Also, once the finger float is attached to the mainwalk float, a single person carrying a load will submerge the floating finger at the outboard end. This thick finger float exhibiting a relatively large differential between the loaded and the unloaded freeboard at the finger end is unsafe to walk on and does make a transfer from boat to finger float somewhat difficult and hazardous. Furthermore, any finger float, whether it is wide or deep, must use a sufficient volume of material to displace the necessary volume of water. This need to utilize a minimum volume of material causes the floats to be relatively expensive and heavy, thereby resulting in fairly expensive shipping costs.

SUMMARY OF THE INVENTION

It is an object of the invention to provide a narrow finger pier which will not sink or drop to an excessive horizontal angle when normal loads are placed on the pier.

It is another object of the invention to provide a relatively narrow finger pier which can be easily attached to existing floats of any type and moved as moorage requirements change.

It is still another object of the invention to provide a relatively narrow finger pier which requires less water depth than is required by conventionally used finger floats.

It is a further object of the invention to provide a relatively narrow finger pier which uses less material than conventional finger floats and is therefore less expensive to manufacture and, by virtue of its lighter weight, less expensive to ship.

These and other objects of the invention are provided by a plurality of finger piers projecting perpendicularly from a plurality of rectangular mainwalk floats arranged end-to-end to form a floating, elongated mainwalk. The finger piers include an elongated frame, an elongated deck covering the frame and fastening means for securing the frame in cantilevered fashion to fastening rods which extend transversely through the mainwalk so that the underside of the finger piers are spaced above from and unsupported by water beneath the piers. In one embodiment the frame is generally triangular in cross-section and formed by three tubular members interconnected by rigid braces. Two of the tubular members extend in a generally horizontal frame above the third tubular members to support the deck. The pier preferably includes an adjusting screw projecting from the sidewall of the mainwalk into the lower tubular member. An adjusting nut is threaded onto the adjusting screw, and it abuts the frame near the end of the lower tubular member. Rotation of the adjusting nut varies the spacing between the side of the mainwalk and the end of the lower tubular member to adjust the vertical angle of the finger pier. A variety of mounting structures may be used to secure the triangularly shaped frame to the fastening rods projecting from the mainwalk. One fastening structure includes a mounting bracket secured to the ends of the upper tubular members adjacent the mainwalk. A pair of the fastening rods project through the mounting bracket, and respective threaded fasteners are secured to the ends of the rod to secure the bracket to the mainwalk. Where a pair of elongated wales extend along the upper side edges of the mainwalk the bracket may also include a second plate extending beneath the wales and secured thereto by a bolt extending vertically through the wales and the second plate. In an alternative mounting structure the fastening rods extend longitudinally through each of the upper tubular members with a fastening member being secured to the end of each rod to secure the tubular members to the mainwalk. In a second embodiment the frame may include a pair of spaced-apart, parallel beams projecting perpendicularly from the mainwalk. The beams may be fastened to the mainwalk by a mounting bracket including a pair of first plates extending along opposite sides of each beam and secured thereto. A second plate occupying a vertical plane parallel to the sides of the mainwalk and perpendicular to the first plate interconnects the first plates and is secured to the mainwalk by the fastening rods. The pier may also include a reinforcing beam mounted between the beams or blocks of buoyant foam mounted between the beams away from the mainwalk to provide the finger pier with buoyancy responsive to unusual loading conditions.

BRIEF DESCRIPTION OF THE DRAWINGS

FIG. 2 is a cross-sectional view of one embodiment of the inventive cantilevered finger pier.

FIG. 3 is a cross-sectional view taken along the line 3—3 of FIG. 2.

FIG. 4 is a detailed view of the fastening means indicated in FIG. 2.

DETAILED DESCRIPTION OF THE INVENTION

Figure 1:
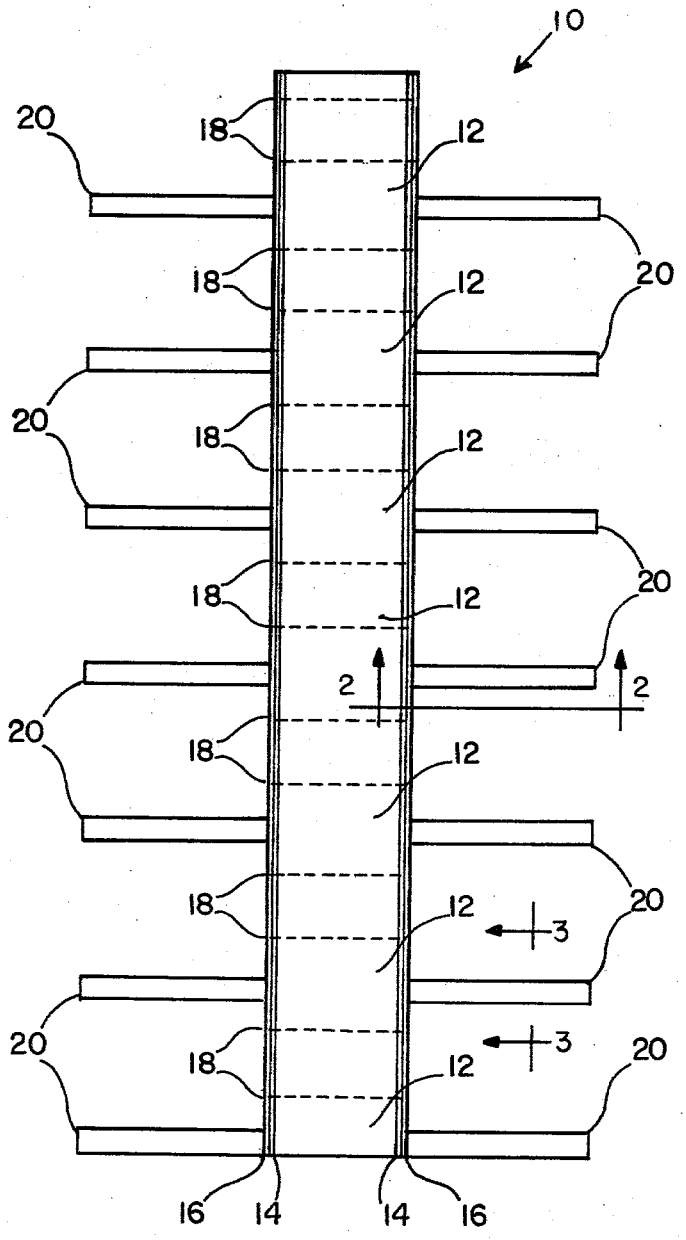
FIG. 1 is a top plan view of either the conventional or inventive variety of marine pier having a floating mainwalk.

A typical marine pier 10 utilizing a plurality of mainwalk floats 12 connected end-to-end is illustrated in FIG. 1. The mainwalk floats 12 are preferably of concrete which is either hollow or filled with a buoyant foam, but it will be understood that other types of floats may also be used. The floats 12 are preferably interconnected by pairs of elongated inner and outer wales 14,16, respectively, which are secured to the ends of rods 18 extending transversely through each of the mainwalk floats 12. A plurality of finger piers 20 project perpendicularly from the mainwalk floats 12 at spaced-apart locations. In conventional installations the finger piers 20 are generally composed of either individual finger floats or a plurality of finger floats fastened to each other end-to-end. The finger piers 20 illustrated in FIG. 1 are relatively narrow as compared with conventional finger piers. Consequently, if the finger piers 20 are of the floating variety, they cannot be expected to exert sufficient buoyant force to withstand normally imposed loads. Boats are normally moored on opposite sides of each finger pier 20, and the distance between the piers 20 as well as the width of the piers 20 is normally a function of the sizes of the boats.

One embodiment of the inventive cantilevered pier is illustrated in FIGS. 2 and 3. This embodiment utilizes a triangularly shaped frame 30 having a deck 32 mounted thereon. As best illustrated in FIG. 3, the frame 30 is composed of two upper, elongated tubular members 34 occupying a horizontal plane and a third tubular member 36 positioned therebeneath. The tubular members 34,36 are interconnected by rigid braces 38 which, as illustrated in FIG. 2, are generally Z-shaped. In actuality, the triangularly shaped frame 30 is not unlike the triangularly shaped towers commonly used to support radio and television antennas. As illustrated in FIG. 3, a pair of mounting brackets 40 project toward each other from the upper surface of the upper tubular members 34 to support the deck 32 which is secured to the brackets 40 by bolts 42 and nuts 44. The deck 32 may be any suitable material such as plywood, wood, metal or the like.

As illustrated in FIG. 2, the finger pier 20 is secured to the mainwalk float 12 with the wales 14,16 positioned therebetween. One embodiment of a mounting structure for securing the finger piers 20 to the mainwalk floats 12 is illustrated in FIG. 4. The ends of the upper tubular members 34 are secured to a first plate 50 such as by welding. It is noted that the first plate 50 occupies a vertical plane parallel to the sides of the mainwalk floats 12 and abuts the outer surface of the outer wale 16. A second plate 52 which occupies a horizontal plane perpendicular to the first plate 50 is secured to the first plate 50 such as by welding. The second plate 52 is fastened to the underside of the wales 14,16 by a bolt 54 extending through the wales 14,16 and the plate 52 and secured with a nut 56. The fastening rods 18 project through the wales 14,16 and the first plate 50 and are secured thereto by nuts 58. Although only one fastening rod 18 is illustrated in FIG. 4 it will be understood that at least two horizontally spaced fastening rods 18 are secured to the plate 50 to allow the piers 20 to withstand horizontal forces normally imparted to the piers 20.

An important feature of the inventive cantilevered pier is the ability to adjust the vertical angle of the pier. In accordance with this feature, an adjusting screw 60 projects from a palate 62 which is mounted on the side of the mainwalk 12. The adjusting screw 60 extends into the interior of the lower tubular member 36. An adjusting nut 64 is tapped to match threads formed on the adjusting screw 60 so that the position of the nut 64 along the length of the adjusting screw 60 may be varied by rotating the nut 64. Since the inner face of the plate 50 abuts the adjusting nut 64, the spacing between the lower edge of the plate 50 and the mainwalk 12, and hence the vertical angle of the pier 20, may be adjusted by simply rotating the adjusting nut 64.

Figure 5:
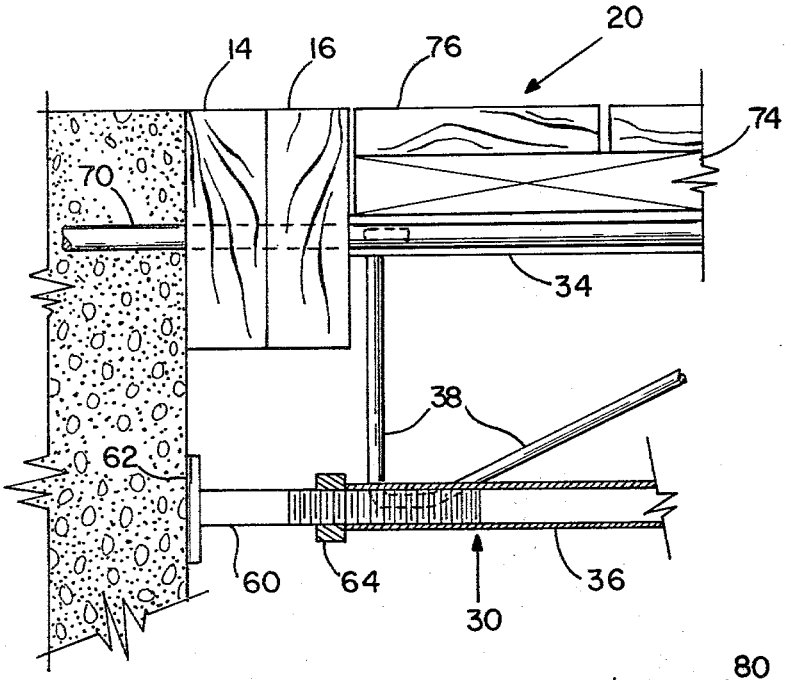
FIG. 5 is an alternative embodiment of the fastening means indicated in FIG. 2.

An alternative embodiment for securing the triangular shaped frame 30 to the mainwalk floats 12 is illustrated in FIG. 5 in which structural components which are identical to components in FIG. 4 are identically numbered. The finger piers of FIG. 5 are secured to the mainwalk float 12 by fastening rods 70 which extend transversely through the mainwalk floats 12 in the same manner as the rods 18 illustrated in FIGS. 1, 3 and 4. However, the fastening rods 70 of FIG. 5 extend throughout the entire length of the upper tubular members 34, and nuts are fastened to the ends of the rods 70 to secure the upper tubular members 34 to the floats 12. Since the fastening rods 70 are positioned a substantial distance below the upper surface of the float 12, a spacer 74 is provided to position the lower surface of the deck above the tubular members 34 so that the upper surface of the deck 76 is flush with the upper surfaces of the float 12 and wales 14,16. As with the embodiment of FIG. 4, the embodiment of FIG. 5 also includes the inventive structure for adjusting the vertical angle of the pier 20.

Figure 6:
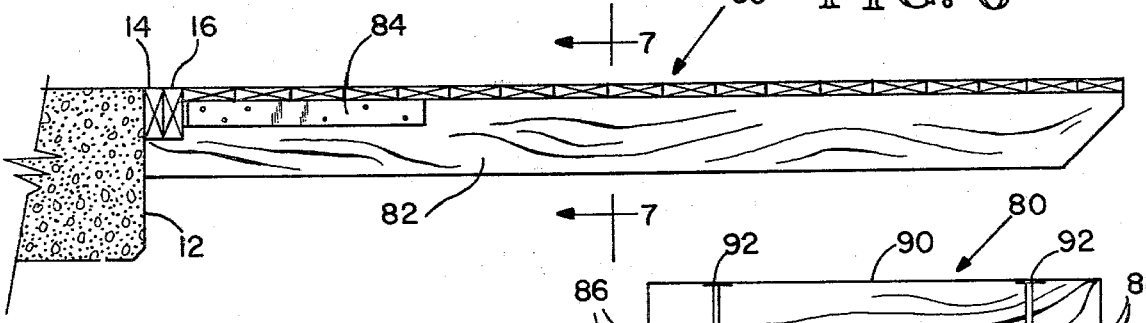
FIG. 6 is a cross-sectional view of an alternative embodiment of the inventive cantilevered finger pier.
Figure 8:
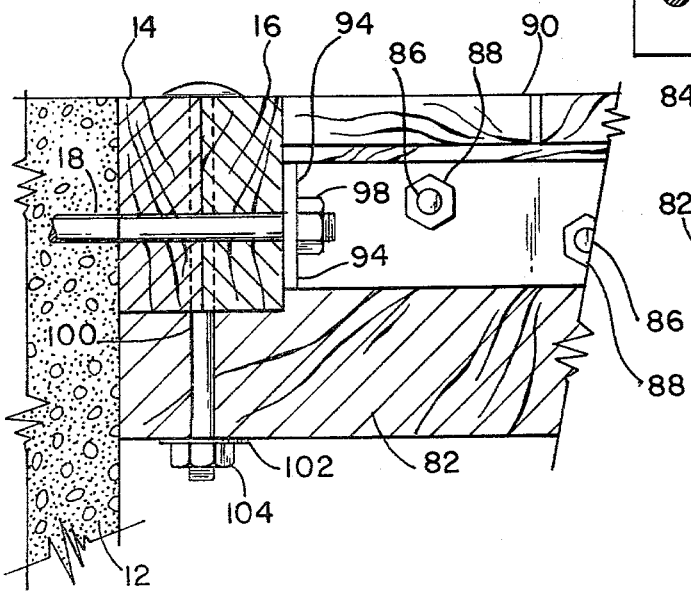
FIG. 8 is a detailed view of the fastening means indicated in FIG. 6.
Figure 7:
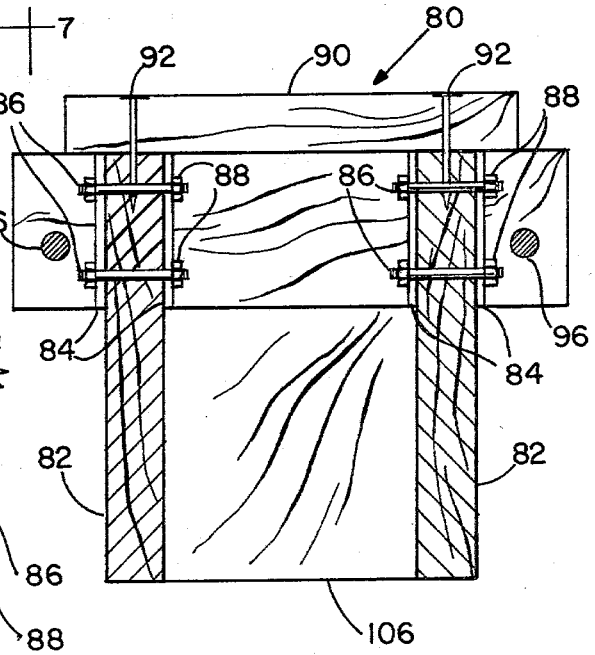
FIG. 7 is a cross-sectional view taken along the line 7—7 of FIG. 6.

An alternative embodiment of the cantilevered pier is illustrated in FIGS. 6–8. In this embodiment the deck supporting frame is formed by a pair of spaced-apart, parallel beams 82 which may be of wood or any other suitable material. Elongated rigid brackets 84 extend along opposite sides of each beam 82 for a substantial distance near the mainwalk floats 12 to support the beams 82 in cantilevered fashion as explained hereinafter. The plates 84 are secured to the beams 82 by bolts 86 extending through the plates 84 and beams 82. The bolts are secured in place by respective nuts 88.

A deck 90 of suitable material such as wood planks is mounted on the upper surfaces of the beams 82 by suitable means such as with nails 92.

The structure for securing the beams 82 to the finger floats 12 in cantilever fashion is best illustrated in FIGS. 7 and 8. The upper ends of the beams 82 adjacent the mainwalk floats 12 are notched to provide clearance for the wales 14,16. A mounting plate extending along the outer surface of the outer wale 16 is secured to the plate 84 by suitable means such as by welding. The mounting plate 94 has formed therein suitably spaced bores 96 (FIG. 7) to receive the ends of the rods 18 which extend transversely through the mainwalk floats 12 as explained above. Respective nuts 98 securely fasten the plate 94 to the rods 18. The beams 82 are also secured to the wales 14,16 by horizontally spaced bolts 100 extending vertically through the wales 14,16 and the beam 82 which are secured in place by respective washers 102 and nuts 104.

As best illustrated in FIG. 7, a filler 106 may be positioned in the space between the beams 82. The filler 106 may be a structural member to further strengthen the pier 80 or it may be a block of buoyant foam positioned between the ends of the beams 82 away from the mainwalk float 12 to provide the pier 80 with buoyancy in the event that the end of the pier 80 receives abnormally heavy loads causing the underside of the pier to enter the water.

Although only two types of frames for supporting the pier 20 are illustrated herein, it will be understood that other frame structures, such as I-beam or T-beam structures, may also be used.

The inventive cantilevered pier is thus able to withstand normally imposed loads without relying on the buoyant force of the pier for support. Consequently, the pier may be relatively narrow to meet the present needs of the marine industry.

I claim:

1. A marine pier, comprising:

a plurality of rectangular mainwalk floats, each formed by a concrete shell surrounded by a buoyant core, said floats being arranged end-to-end to form a floating, elongated mainwalk, said mainwalk floats having elongated wales extending along their upper longitudinal edges and a plurality of fastening rods extending transversely therethrough with their ends projecting through respective wales and securing said wales to said floats;

a plurality of finger piers projecting perpendicularly from said mainwalk at space-apart locations, each of said finger piers including an elongated frame and an elongated deck covering said frame; and a bracket securing said frame to said fastening rods along the outer surfaces of said wales in cantilever fashion with the underside of said finger pier normally spaced above from and unsupported by water beneath said pier such that said finger piers are rigidly secured to said floats despite the presence of said wales using the fastening rods which secure said wales to said floats.

2. The marine pier of claim 1, wherein said frame is generally triangular in cross-section formed by three tubular members extending along the vertices of said triangle and interconnected by braces with two upper tubular members positioned in a generally horizontal plane above a lower tubular member to support said deck.

3. The marine pier of claim 2, wherein a pair of elongated wales extend along the upper side edges of said mainwalk, and said bracket includes a first plate occupying a plane parallel to the side of said mainwalk to which said upper tubular members and said fastening rods are secured with said wales positioned between said mainwalk and said first plate, and a second plate occupying a plane beneath said wales which is parallel to the deck of said finger pier and perpendicular to said first plate, said pier further including an elongated fastening member projecting vertically through said wales and said second plate to secure said second plate to the underside of said wales.

4. The marine pier of claim 2, wherein one of said fastening rods extends longitudinally through each of said upper tubular members with a fastening member being secured to the end of each rod to secure said tubular members to said mainwalk.

5. The marine pier of claim 2, wherein said frame includes a pair of spaced-apart, parallel beams projecting perpendicularly from said mainwalk and having said deck mounted therebetween, and wherein said fastening means includes a pair of elongated first plates extending alng opposite sides of each beam and secured thereto, and a second plate interconnecting said first plates and occupying a vertical plane parallel to the side of said mainwalk and perpendicular to said first plates, said second plate having a pair of bores formed therein through which two of said fastening rods pass, and threaded fasteners secured to the ends of said rod to secure said bracket to said mainwalk.

6. The marine pier of claim 5, wherein said beams are of wood and said brackets are metal, said first brackets being secured to said beams by a plurality of bolts extending through said beam between said first plates.

7. The marine pier of claim 5, wherein said beams are of wood and said deck includes a plurality of boards extending between the upper surfaces of said beams and secured thereto by nails extending through said boards into said beam.

8. The marine float of claim 5, further including a reinforcing member mounted between said beams beneath said deck.

9. The marine float of claim 5, further including buoyant foam mounted between said beams away from said mainwalk to provide buoyancy to said finger pier responsive to unusual loading at the end of said pier.

* * * * *